US007974547B2

(12) United States Patent
Brewer, III et al.

(10) Patent No.: US 7,974,547 B2
(45) Date of Patent: Jul. 5, 2011

(54) HEAT EXHAUST PLENUM ATTACH/DETACH MECHANISM

(75) Inventors: Charles R Brewer, III, Farmington, NY (US); Thomas C Palumbo, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 455 days.

(21) Appl. No.: 12/256,489

(22) Filed: Oct. 23, 2008

(65) Prior Publication Data

US 2010/0104314 A1 Apr. 29, 2010

(51) Int. Cl.
*G03G 15/00* (2006.01)
*G03G 21/20* (2006.01)

(52) U.S. Cl. ..... 399/92; 399/107

(58) Field of Classification Search ..... 399/92, 399/94, 320, 107
See application file for complete search history.

(56) References Cited

U.S. PATENT DOCUMENTS

| | | | | |
|---|---|---|---|---|
| 4,388,274 | A * | 6/1983 | Rourke et al. | 422/177 |
| 5,819,137 | A * | 10/1998 | Hoffman et al. | 399/92 X |
| 6,174,340 | B1 * | 1/2001 | Hodge | 55/385.1 |
| 7,274,892 | B2 | 9/2007 | Awaya | |
| 7,315,721 | B2 | 1/2008 | Kitayama | |
| 7,748,698 | B2 * | 7/2010 | Shelhart | 271/97 |
| 2009/0016929 | A1 * | 1/2009 | Garrett | 422/4 |

* cited by examiner

*Primary Examiner* — Sophia S Chen

(57) ABSTRACT

A simple and cost effective method of simplifying and speeding heat exhaust plenum attachment and detachment from a machine that uses metal for exterior covers and air output grills includes placing magnetic sheeting around that portion of the plenum that mates with the back of the machine and allowing the magnetic force of the sheeting to attach the plenum to the machine. The plenum can easily be detached from the machine by overcoming the magnetic force of the sheeting.

20 Claims, 3 Drawing Sheets

HEAT EXHAUST PLENUM ATTACH/DETACH MECHANISM

This invention relates generally to an image forming apparatus, such as, a printer, copying machine, etc., that includes several functions that require image formation, and more particularly, to image forming devices that include a duct for discharging heat, ozone, and the like.

High production laser printers, as for example, laser printer 10 shown in FIG. 1, copying machines, and other image forming devices include a photosensitive member. To form images, the surface of the photosensitive member is charged using a corona discharge. The charged surface is then exposed with light from a laser or light emitting diode. Exposed portions on the surface of the photosensitive member form an electrostatic latent image. The electrostatic latent image is developed by toner into a visual toner image. The toner image is transferred fro the photosensitive member onto a recording medium, such as, paper. The toner image is thermally fixed onto the recording medium by a fixing device.

Heat is generated from various components used in the process. For example, a scanner motor is provided for rotating a polygon mirror to scan a laser beam across the surface of the photosensitive member. The scanner motor generates heat as it rotates the polygon mirror during image formation. Also, the fixing device itself generates heat. A duct 16 is provided at an outlet vent of the image forming device to exhaust the heat to outside of the main body 16. Also, printer 10 is a high speed, continuous feed apparatus and high speed operation of the image forming apparatus has increased the amount of heat generated by the components of the apparatus. The duct is used to remove this heat so that the interior of the image forming apparatus may not be filled with hot air produced by the fixing device.

Other attempts have been made toward controlling heat generated within image forming apparatuses. For example, U.S. Pat. No. 7,274,892 B2 is directed to an image forming apparatus with heat exhaustion means for exhausting air from around a fixing unit by providing heat exhausting fans in the vicinity of a fixing device. Also, U.S. Pat. No. 7,315,721 B2 discloses an image forming apparatus that uses a cooling fan to supply air into a fixing unit.

However, these and other attempts to control heat within a printer have not addressed a problem encountered in attaching heat exhaust or air handling plenums to air outlet vents on the body of an imaging apparatus. The process usually involves the use of mechanical hardware (screws, bolts, clamps) to secure a plenum to a machine rear cover or exhaust port. For larger printer applications that involve the use of metal for exterior covers and air output grills, the addition of holes may be required to attach plenums as accessories to the machine.

Thus, there is a need simplify and make less time consuming and costly the attachment and detachment of heat exhaust or air handling plenums to the rear of a printing apparatus.

In accordance with various aspects described herein, disclosed is an air handling or heat exhaust plenum which attaches directly to a printer output point or exhaust by using magnets as the mechanical means of attachment. The plenum has thin magnet sheeting on the side of the plenum that mates with the back of the printer, thereby facilitating easy attachment to and detachment of the plenum from the case of the printer.

The disclosed system may be operated by and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'printer' or 'reproduction apparatus' as used herein broadly encompasses various printers, copiers or multifunction machines or systems, xerographic or otherwise, unless otherwise defined in a claim. The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposers or inserters to add covers or other inserts to the compiled sets.

As to specific components of the subject apparatus or methods, or alternatives therefor, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

Figure 1:
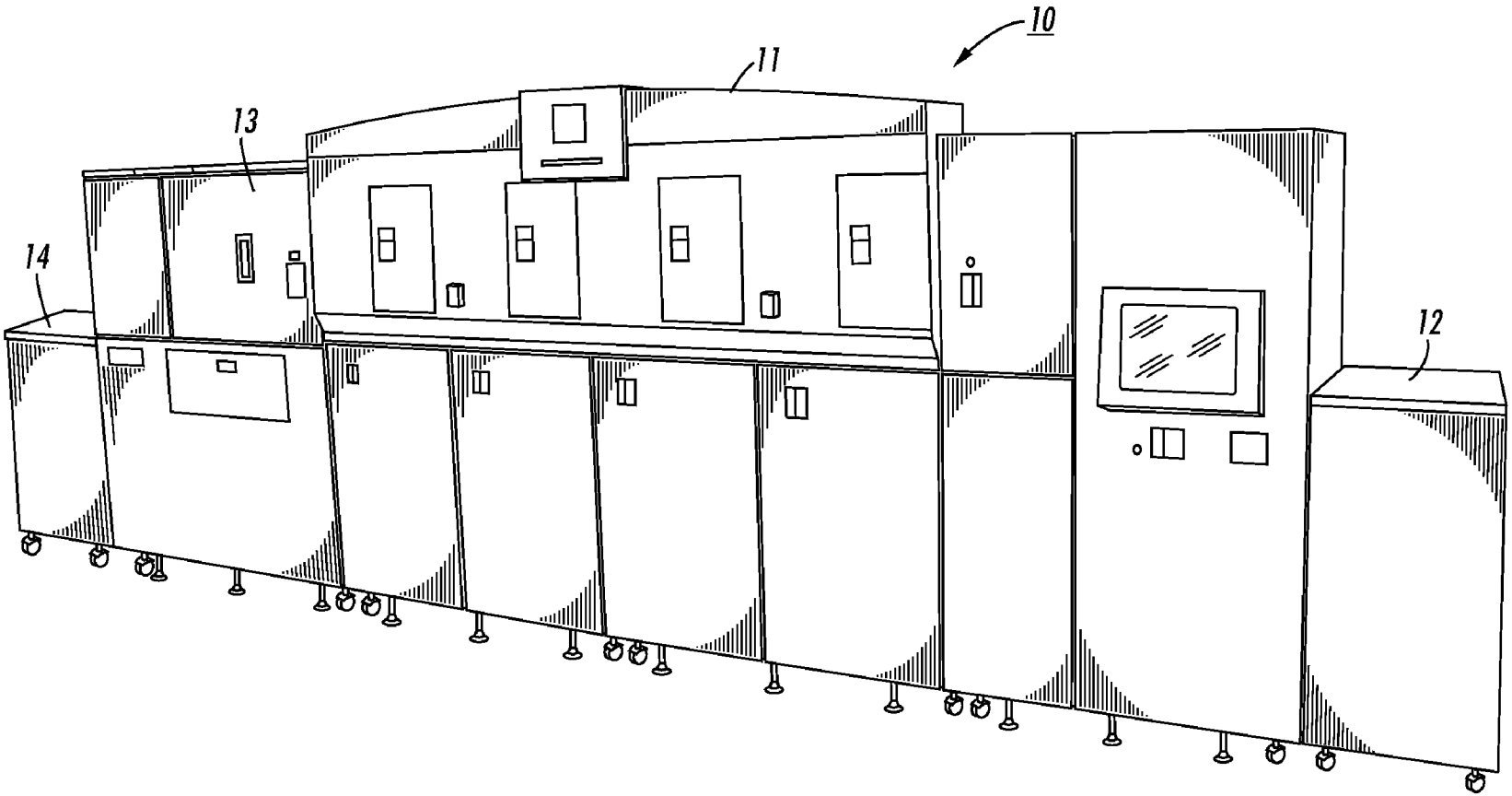
FIG. 1 is a schematic frontal view of a conventional, continuous feed, high production printer.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes the improved heat exhaust plenum of the present disclosure.

For a general understanding of the features of the disclosure, reference is made to the drawings. In the drawings, like reference numerals have been used throughout to identify identical elements.

Referring to FIG. 1, a conventional printer 10 is shown that uses an electrostatic printing system that is well known. The term "printing system" as used here encompasses a printer apparatus, including any associated peripheral or modular device which performs a print input or outputting function. Marking module 11 includes a photoreceptor belt that advances in a predetermined direction through the various processing stations along the path of the belt. A first charger charges an area of the belt to a relatively high, substantially uniform potential. Next, the charged area of the belt passes a first laser to expose selected areas of the belt to a pattern of light, to discharge selected areas to produce an electrostatic latent image. Next, the illuminated area of the belt passes a developer unit which deposits magenta toner on charged areas of the belt.

A conventional roll feeder module 12 registers and feeds a continuous sheet into contact with the image on the photoreceptor belt.

Subsequently, a second charger charges the area of the belt to a relatively high, substantially uniform potential. Next, the charged area of the belt passes a second laser to expose selected areas of the belt to a pattern of light, to discharge selected areas to produce an electrostatic latent image. Next, the illuminated area of the belt passes a second developer unit which deposits yellow toner on charged areas of the belt.

Subsequently, a third charger charges the area of the belt to a relatively high, substantially uniform potential. Next, the charged area of the belt passes a third laser to expose selected areas of the belt to a pattern of light, to discharge selected areas to produce an electrostatic latent image. Next, the illuminated area of the belt passes a third developer unit which deposits cyan toner on charged areas of the belt.

Subsequently, a fourth charger charges the area of the belt to a relatively high, substantially uniform potential. Next, the charged area of the belt passes a fourth laser to expose selected areas of the belt to a pattern of light, to discharge selected areas to produce an electrostatic latent image. Next, the illuminated area of the belt passes a fourth developer unit which deposits black toner on charged areas of the belt. As a result of the foregoing processing described above, a full color toner image is now moving on the photoreceptor belt.

A prefuser transport moves the continuous sheet to a fuser 13, which permanently affixes the toner to the sheet with heat and pressure. The sheet then advances to a conventional cutter/stacker module 14. A cleaner removes toner that may remain on the image area of the photoreceptor belt.

Figure 2:
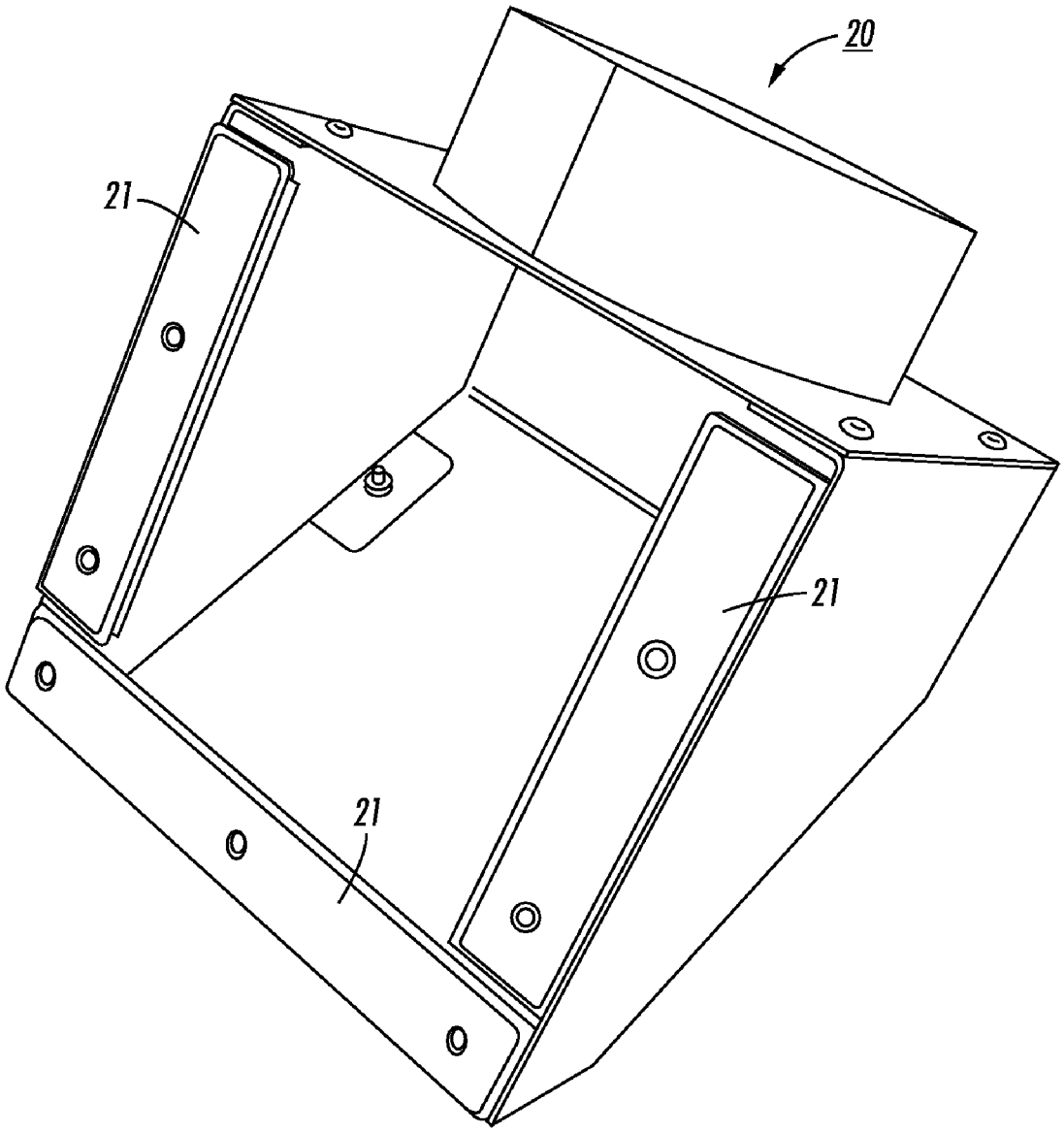
FIG. 2 is a schematic perspective view of the heat exhaust plenum in accordance with the present disclosure.
Figure 3:
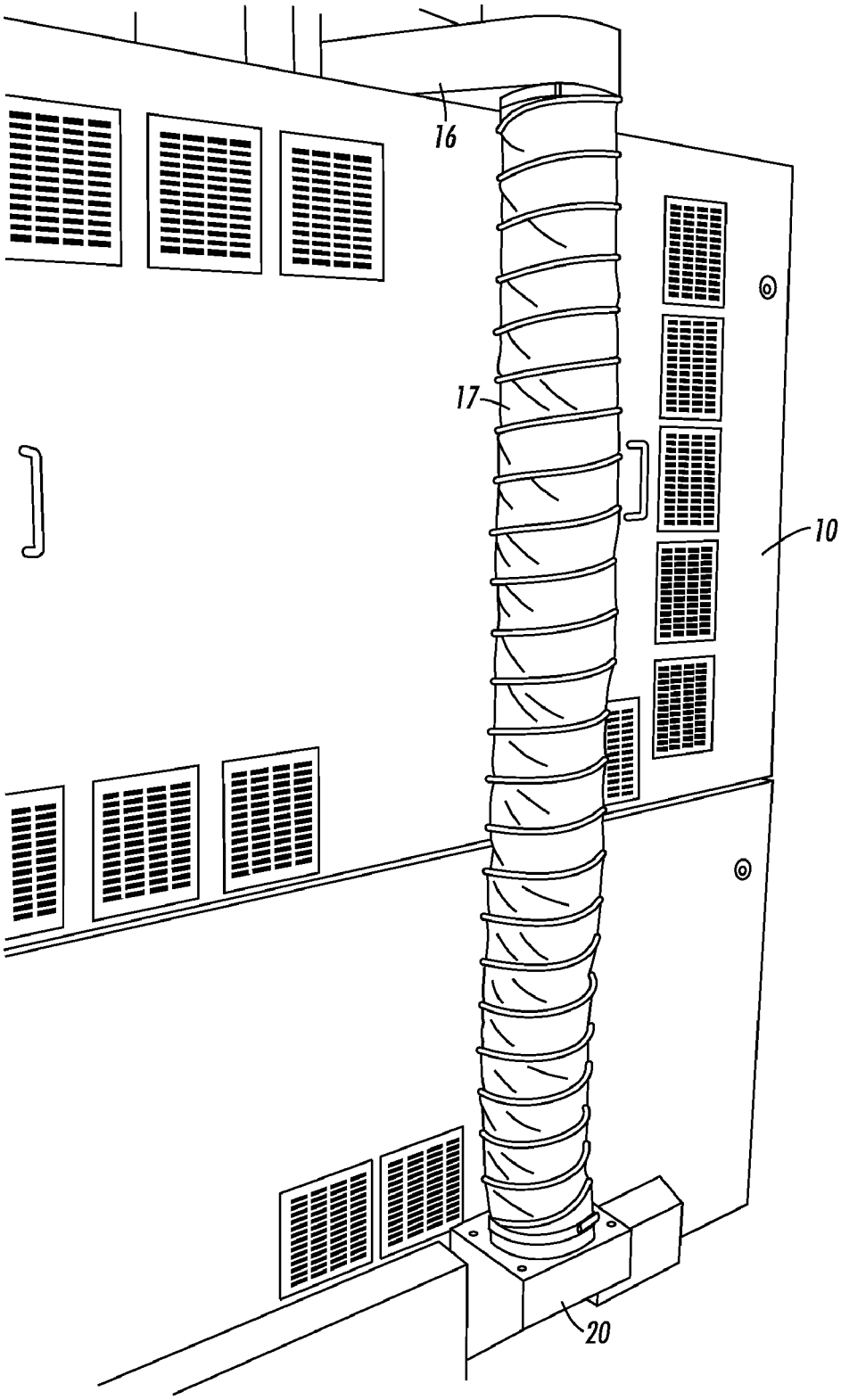
FIG. 3 is a schematic rear view of the printer of FIG. 1, showing the exhaust plenum of FIG. 2 attached thereto.

With reference to the FIGS. 2 and 3, and in accordance with the present disclosure, a magnetically attachable plenum 20 is shown attached to printer 10 and connected to flexible exhaust coil 17 that is in turn connected to exhaust duct 16 that directs heat away from the machine. Plenum 20, which can be constructed of metal, such as, steel or aluminum can also be made of plastic. Channel type thin magnetic sheeting 21 is attached on the side of the plenum that mates with the back of the production printer with sufficient strength to provide enough holding force for normal operation of the exhaust system, but will easily be removable by service personnel. When the printer is at it final destination the plenum is secured to the printer by the magnetic force in the magnetic sheeting. An advantage of using channel magnets to adhere the plenum to the back of the printer includes not having to drill holes in the printer to allow attachment by screws or bolts. In addition, no tools are needed to access and remove the heat exhaust system, thus reducing the time necessary to remove the heat exhaust system.

It should now be understood that a low cost magnetically attachable plenum has been disclosed that can easily be attached and removed from the metal back panel of large production printers without the need to drill holes or use tools. The plenum has thin magnet sheeting around an inlet portion thereof that is adapted to be positioned by magnetic force of the magnet sheeting tightly against an air outlet in the back of the printer. The magnetic force of the magnet sheeting is such that the plenum can be easily attached to or detached from the air outlet.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A xerographic device adapted to print an image onto a copy sheet, comprising:

an imaging apparatus for processing and recording an image onto said copy sheet;

an image development apparatus for developing the image;

a transfer device for transferring the image onto said copy sheet;

a fuser for fusing the image onto said copy sheet; and a heat exhaust system for removing heat from said xerographic device produced by said fuser, said heat exhaust system including a plenum having an inlet portion adapted to be easily attached to and detached from an air outlet of said xerographic device, said heat exhaust system including a flexible exhaust hose connected to an outlet thereof, and wherein said inlet portion of said plenum includes magnetic material on a portion of the circumference of said inlet portion of said heat exhaust plenum.

2. The xerographic device of claim 1, wherein said magnetic material is a thin magnetic sheeting.

3. The xerographic device of claim 2, wherein said inlet portion of said plenum is rectangular.

4. The xerographic device of claim 3, wherein said magnetic sheeting is in a plurality of separate rectangular strips.

5. The xerographic device of claim 4, wherein said plurality of separate rectangular strips comprises at least two strips.

6. The xerographic device of claim 5, wherein said plurality of separate rectangular strips comprises three strips.

7. The xerographic device of claim 6, wherein said plenum is made of plastic.

8. The xerographic device of claim 1, wherein said magnetic material is a channel magnet.

9. The xerographic device of claim 8, wherein said plenum is made of metal.

10. A method of removing heat from a xerographic device adapted to print images onto a copy sheets, comprising:

providing an imaging apparatus for processing and recording an image onto said copy sheet;

providing an image development apparatus for developing the image;

providing a transfer device for transferring the image onto said copy sheet;

providing a fuser for fusing the image onto said copy sheet; and providing a heat exhaust system separate from said xerographic device for removing heat from said xerographic device produced by said fuser, said heat exhaust system including a plenum having an inlet portion configured to be effortlessly attached to and detached from an air outlet of said xerographic device, and wherein said inlet portion of said heat exhaust plenum includes magnetic material on a portion of the circumference of said inlet portion of said heat exhaust plenum.

11. The xerographic device of claim 10, including providing a flexible exhaust hose connected to an outlet of said plenum.

12. The xerographic device of claim 10, wherein said magnetic material is a thin magnetic sheeting.

13. The xerographic device of claim 12, wherein said inlet portion of said heat exhaust plenum is rectangular.

14. The xerographic device of claim 13, wherein said magnetic sheeting is in a plurality of separate rectangular strips.

15. The xerographic device of claim 14, wherein said plurality of separate rectangular strips comprises at least two strips.

16. The xerographic device of claim 15, wherein said plurality of separate rectangular strips comprises three strips.

17. The xerographic device of claim 16, wherein said plenum is made of plastic.

18. The xerographic device of claim 10, wherein said magnetic material is a channel magnet.

19. The xerographic device of claim 18, wherein said heat exhaust plenum is made of metal.

20. An apparatus adapted to print an image onto a copy sheet, comprising:

an imaging unit for processing and recording an image onto said copy sheet;

an image development unit for developing the image;

a transfer device for transferring the image onto said copy sheet;

a fuser for fusing the image onto said copy sheet; and a separate and detached heat exhaust system for removing heat from said apparatus produced by said fuser, said separate and detached heat exhaust system including a plenum having an inlet portion adapted to be easily attached to and detached from an air outlet of said apparatus, and wherein said inlet portion of said heat exhaust plenum includes magnetic material on a portion of the circumference of said inlet portion of said plenum.

* * * * *